United States Patent [19]

Kabat et al.

[11] Patent Number: 4,930,470

[45] Date of Patent: Jun. 5, 1990

[54] COMPOSITE ENGINE BLOCK

[75] Inventors: Daniel M. Kabat, Oxford; Dominic Fontichiaro, Dearborn Heights, both of Mich.

[73] Assignee: Ford Motor Company, Dearborn, Mich.

[21] Appl. No.: 462,520

[22] Filed: Jan. 9, 1989

[51] Int. Cl.[5] ..... F02F 7/00

[52] U.S. Cl. ..... 123/195 R; 123/41.74; 123/41.83; 123/195 C

[58] Field of Search ..... 123/41.74, 41.81, 41.83, 123/41.84, 195 R, 195 C

[56] References Cited

U.S. PATENT DOCUMENTS

| | | | |
|---|---|---|---|
| 3,168,081 | 2/1965 | Bauer | 123/41.74 |
| 3,996,913 | 12/1976 | Hamparian | 123/41.83 |
| 4,446,827 | 5/1984 | Kobozuka | 123/195 R |
| 4,446,906 | 5/1984 | Ackerman et al. | 164/132 |
| 4,726,334 | 2/1988 | Holtzberg et al. | 123/195 R |
| 4,759,317 | 7/1988 | Ampferer | 123/41.74 |
| 4,848,292 | 7/1989 | Holtzberg | 123/195 C |

*Primary Examiner*—Noah P. Kamen

*Attorney, Agent, or Firm*—Joseph W. Malleck; May Roger L.

[57] ABSTRACT

A composite engine block for an internal combustion engine having a fluid cooling jacket, comprising a bipartite liner structure with metal (i.e., aluminum alloy or cast iron) defining at least the combustion zone walls, the structure having one or more open cylinders of a first part mateable with a corresponding cylinder head of a second part, the first part having (i) an integral base plate extending transversely outwardly from the cylinder to define a lower imperforate membrane for the bottom of the cooling fluid jacket, and (ii) walls extending dependently from the base plate to support a crankshaft for rotation about an axis transverse to the cylinder, the second part having an integral top plate extending transversely outwardly over the cylinder head to define an upper imperforate membrane for the top of the cooling fluid jacket; (b) a tri-partite skin structure comprised of nonmetallic light weight, vibration damping material (i.e., glass fiber reinforced phenolic) forming substantially the outer wall of the engine, said skin structure having a first tube-like member sealed between the top and bottom plates to complete the water jacket a second part covering over the second part of the liner structure, and a third part covering under the first part of the liner structure; and (c) means for compressibly maintaining mating between the ends of the first tube-like member of the skin structure and the plates.

11 Claims, 3 Drawing Sheets

COMPOSITE ENGINE BLOCK

BACKGROUND OF THE INVENTION

1. Technical Field

This invention relates to the art of making light weight engine blocks, and more particularly to fluid cooled blocks requiring wet liners to define a water jacket.

2. Discussion of the Prior Art

In an effort to design light weight engine blocks, lighter weight metals, such as aluminum, have been formed into a shell for an iron-based liner structure, either two-piece or monoblock. It is desirable that the liner structure be exposed directly to cooling fluid to enhance thermal transfer. (See U.S. Pat. Nos. 4,446,906 and 4,759,317). These designs split the shell at conventional locations forming a joint between the crankcase chamber and the cooling chamber. If plastic or plastic composites were to be substituted for the exterior shell, cooling fluids containing chemicals that degrade sealing means over the life of the engine block would cause problems. Thus, the concept, such as presented in U.S. Pat. No. 4,446,827, would promote the possibility for contamination of engine oil within the crankcase chamber by leakage of coolant thereinto.

It is an object of this invention to provide a fluid cooled engine block that deploys light weight nonmetallic materials, such as plastic composites, for an outer shell of the water jacket without any risk of oil contamination by the cooling fluid.

SUMMARY OF THE INVENTION

This invention is a composite engine block for an internal combustion engine having a cooling fluid jacket, comprising: (a) a bipartite liner structure having metal defining at least the combustion zone walls, the structure having one or more open cylinders of a first part mateable with a corresponding cylinder head of a second part, the first part having (i) an integral base plate extending transversely outwardly from the cylinder to define a lower imperforate membrane for the bottom of the cooling fluid jacket, and (ii) walls extending dependently from the base plate to support a crankshaft for rotation about an axis transverse to the cylinder, the second part having an integral top plate extending transversely outwardly over the cylinder head to define an upper imperforate membrane for the top of the cooling fluid jacket; (b) a skin structure comprised of nonmetallic light weight, vibration damping material forming substantially the outer wall of the engine, said skin structure having a first cylindrical member sealed between the top and bottom plates to complete the water jacket; and (c) means for compressibly maintaining mating between the ends of the first cylindrical member of the skin structure and the plates.

The bipartite liner structure preferably is comprised of material stable under temperatures of 450–700° F. The metal of the liner structure occupies at least the combustion zone walls which is preferably comprised of the head, at least the upper two-thirds of the cylinder, and the exhaust passages.

Preferably, the skin structure is mated to the liner structure by use of stepped annular joints at each of the respective plates with a mechanical gasket type seal at one of the steps of such joint and a fluid pressure induced seal at the other of such steps. Compression is preferably achieved by use of threaded fasteners extending between (i) one of the plates, and (ii) integral lugs extending radially outwardly from the structure possessing the other of the plates; the lugs are effective to receive the threaded end of such fasteners.

Preferably, the skin structure is tripartite with a second part defined as upstanding walls projecting over the head and its plate to form a camshaft and valve train chamber, and a third member covering under the base plate and any dependent walls to form a crankcase oil chamber.

DETAILED DESCRIPTION AND BEST MODE

Figure 1:
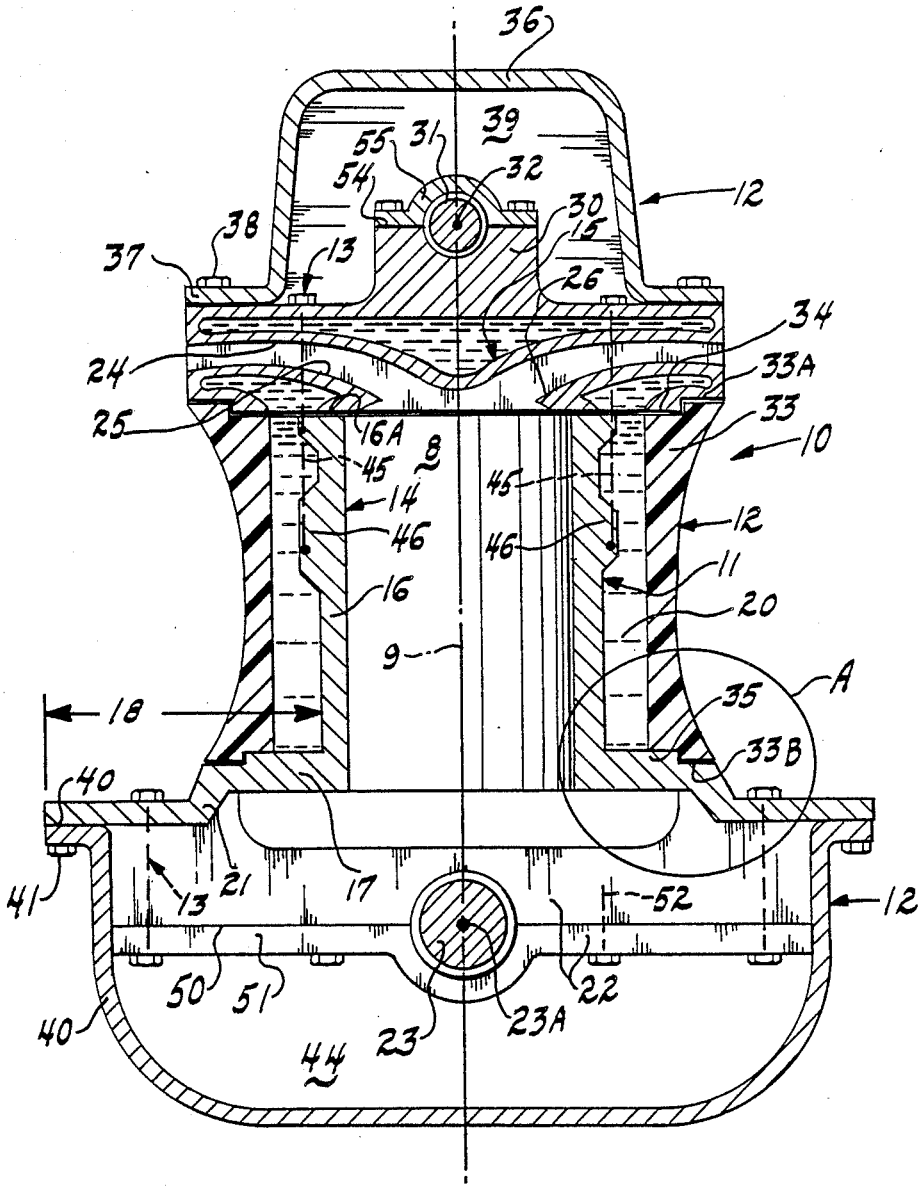
FIG. 1 is a central sectional elevational view of the composite engine block of this invention.
Figure 2:
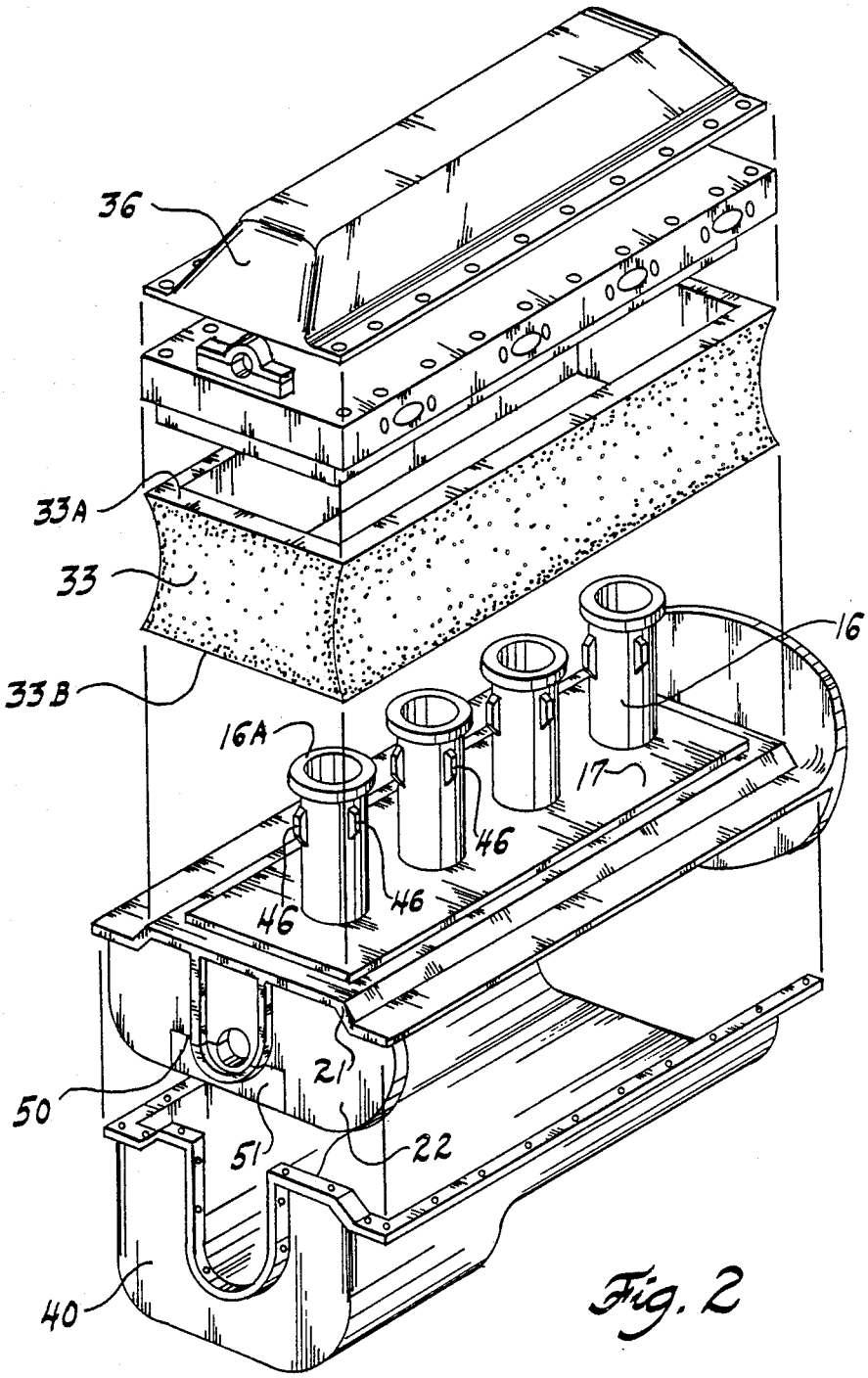
FIG. 2 is an exploded perspective view of the parts of the structure shown in FIG. 1.

As shown in FIGS. 1 and 2, the engine block 10 is comprised of a bipartite liner structure 11 which forms a metallic high temperature resistant skeleton for the block, a tripartite skin structure 12 mounted on the liner structure by compression means 13 effective to provide a sealed water jacket 20.

The bipartite liner structure 11 can be comprised of metals such as aluminum alloy or cast iron. Cast iron is the preferred structure because it is stable at temperatures of at least 500° F. and up to 700° F. Such liner structure comprises at least the walls for a combustion zone 8. The first part 14 of the liner structure is a plurality of aligned open cylinders 16, each cylinder having its axis 9 in an upright position and within a common plane. The upper annular end 16A of each of the cylinders 16 is adapted to mate with a head 15, defining the second part of the liner structure. Each of the heads for the open cylinders 16 are integrated together to a unitary metallic part.

The first part of the liner structure further consists of an integral plate 17 extending transversely outwardly from the bottom of each of the cylinders 16 a distance 18 of about 3–4 inches sufficient to extend beyond the water jacket; the plate may have a thickness 19 of about 0.50 inches. The plate 17 may be stepped at 21 on opposite sides of the row of cylinders to facilitate attachment of the second part of the skin structure.

The first part of the liner structure also has of walls 22 depending downwardly at fore and aft locations of the plate 17, each wall 22 serving to support a crankshaft 23 in a position where the crankshaft will be rotatable about an axis 23A transverse to the cylinder axes 9. The walls 22 may be split at 50 or separately cut to form bearing caps 51 secured by fasteners 52.

The second part 15 of the liner structure has walls 24 defining intake passages 25 and exhaust passages 26 leading from the combustion chamber 8. Such second part has an integral top plate 27 extending transversely outwardly over the head 15 to define an imperforate membrane for the top of the cooling jacket 20. Such second part also has upstanding walls 30 integral with and projecting from the plate 27 to provide a support for a camshaft 31 in a position for rotation about an axis 32 transverse to the cylinder axes 9. The walls 30 may be split at 54 to form bearing caps 55.

The tripartite skin structure 12 is comprised of nonmetallic, vibration damping, light weight materials, preferably plastic composites, such as glass fiber reinforced phenolic and which has a density in the range of 115–120 pounds mass per cubic foot. Such skin structure has a first tube-like member 33 surrounding the cylinders, positioned between the top and bottom plates 17 and 27, and sealed against fluid passage at 34, 35 to complete the water jacket 20.

An independent second member 36 is provided to cover over the head 15 of the liner structure and is attached at its periphery 37 by way of fasteners 38 with a gasket interposed therebetween. Such second member is effective to provide definition of a camshaft chamber 39 which may include a valvetrain system.

The skin structure further comprises a third member 40 covering under the base plate 17 and the aforementioned dependent walls 22 forming support for the crankshaft. Such third member provides definition of a crankcase oil chamber 44 and is attached to the base plate 17 at location 40 by way of fasteners 41 which are received in threaded openings in the plate with gaskets interposed therebetween.

The compression means 13 is effective to apply compression forces between the ends 33A and 33B of the tube-like member 33 and the plates 27 and 17 respectively. This is brought about by having a plurality of bolts 45 extending from at least one of such plates (here plate 27) alongside the cylinders 16 to be threadably received by lugs 46 integrally formed to the outer diameter of the cylinders. Although the lugs are shown at a mid-position of the cylinders, they may preferably be formed near the base of each of such cylinders to avoid distortion due to thermal conditions. The first member being secured without need of mechanical fasteners attached thereto.

Figure 3:
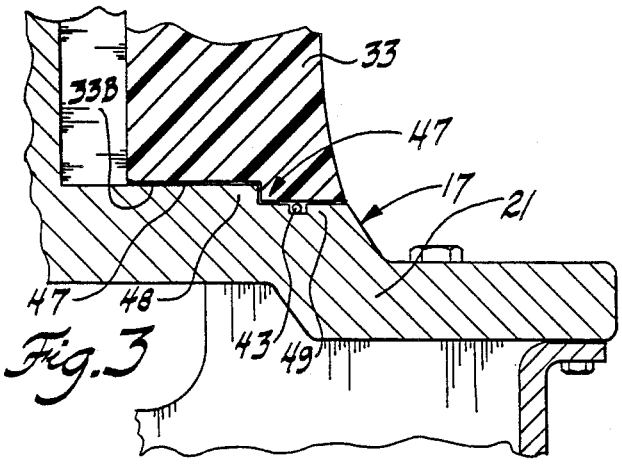
FIGS. 3–5 are enlarged sectional views of the portion labeled "A" in FIG. 1, showing different alternative modes for sealing the stepped juncture between the skin structure and the liner structure.
Figure 4:
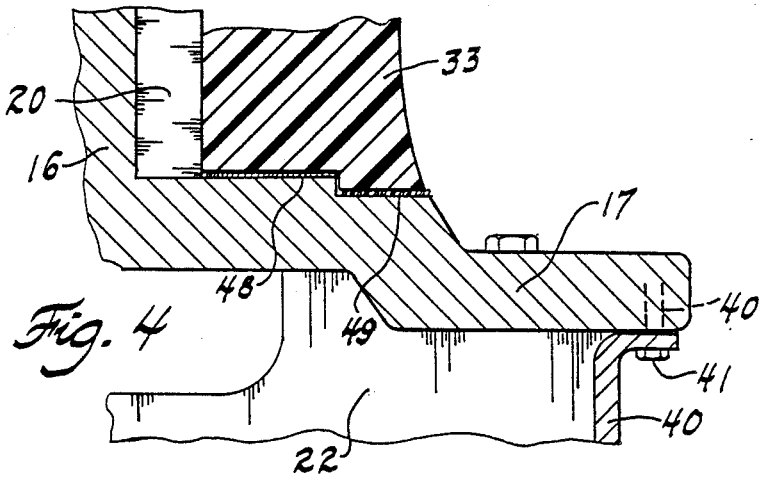
Figure 5:
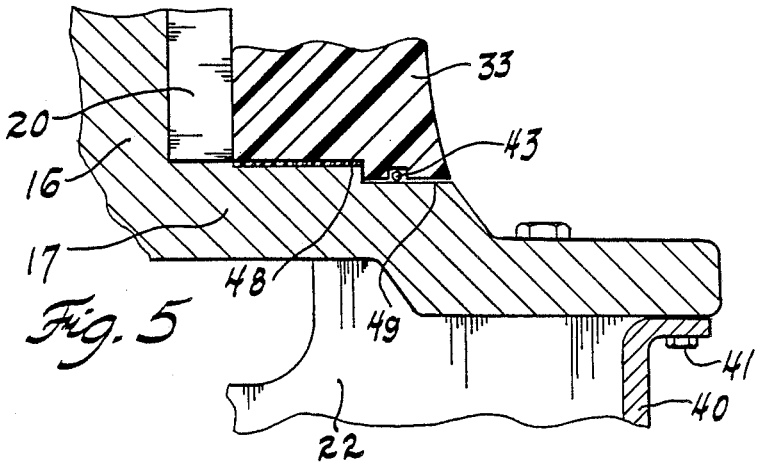

As shown in FIGS. 3–5 compression forces are effective to close stepped joints 47 defined peripherally around the plate 17 and around plate 27. Each of the stepped joints have a first step 48 containing a gasket 42 or flat surface type seal sealed by mechanical clamping force, and a second step 49 sealed by fluid pressure such as by as an O-ring 43. These stepped joints are sealed on the exterior of the block providing no path for leakage to the crankcase 44.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of the invention.

What is claimed:

1. A composite engine block for an internal combustion engine having a fluid cooling jacket, comprising:

(a) a bipartite liner structure having metal defining at least the combustion zone walls, said liner structure having one or more open cylinders defining a first part and having a cylinder head, mateable with said first part, defining a second part, said first part having (i) an integral base plate extending transversely outwardly from the cylinders to define a lower imperforate membrane for the bottom of said fluid cooling jacket, and (ii) walls extending dependently from said base plate to support a crankshaft for rotation about an axis transverse to said cylinder, said second part having an integral top plate extending transversely outwardly over the cylinder head to define an upper imperforate membrane for the top portion of the fluid cooling jacket;

(b) a skin structure comprised of nonmetallic light weight, vibration damping material forming substantially the outer walls of said engine, said skin structure having a first tube-like member sealed between said top and bottom plates to complete said water jacket; and (c) means for securing and compressing said first member bewteen said plates to seal the ends of the first member against said plates, said first member thereby being secured without need of mechanical fasteners attached thereto.

2. A block as in claim 1, in which said combustion zone surfaces include at least two-thirds of the upper portion of the cylinders, the head for the cylinder bores, and exhaust passages, said surfaces being stable at temperatures up to 650° F.

3. A block as in claim 2, in which said cooling jacket surrounds at least the upper portions of said cylinder, head, and exhaust passages.

4. A block as in claim 1, in which said aligned cylinders have axes which lie in a common plane generally perpendicular to the base plate.

5. A block as in claim 1, in which said skin structure is tripartite, a second part covering over the second part of said liner structure, and a third part covering under the base plate and dependent walls of the liner structure.

6. A block as in claim 1, in which said second part of said liner structure has upstanding walls to support a camshaft for rotation about an axis transverse to the cylinder axes.

7. A block as in claim 1, in which said skin structure is comprised of plastic composite material.

8. A block as in claim 7, in which said plastic composite material is glass fiber reinforced phenolic.

9. A block as in claim 1, in which the cylinder member of the first part of said skin structure is sealed at its upper and lower ends to said plates by annular stepped joints therebetween maintained in compression by threaded fasteners extending between the top plate and lugs integrated to the sides of said cylinders.

10. A block as in claim 9, in which said sealing within said stepped joints is provided by a surface-to-surface seal in one of said steps promoted by mechanical force and by sealing in the second step promoted by fluid pressure acting thereagainst.

11. A block as in claim 9, in which said compression means comprises lugs spaced circumferentially about and extending radially outwardly from the cylinders, and threaded fasteners extending from the top plate into threaded receptacles within each of said lugs.

* * * * *